US005311947A

United States Patent [19]

Kent et al.

[11] Patent Number: 5,311,947

[45] Date of Patent: May 17, 1994

[54] PRESELECTED CASING TENSIONING SYSTEM

[75] Inventors: Peter M. Kent, Warthill by Inverurie; Norman Brammer, Fyvie Turiff, both of Scotland

[73] Assignee: ABB Vetco Gray Inc., Houston, Tex.

[21] Appl. No.: 943,280

[22] Filed: Sep. 10, 1992

[51] Int. Cl.[5] ..... E21B 33/14

[52] U.S. Cl. ..... 166/348; 166/382; 166/77.5; 285/143; 285/307; 285/323

[58] Field of Search ..... 166/77.5, 98, 124, 125, 166/216, 217, 208, 348, 382; 285/141-143, 307, 323

[56] References Cited

U.S. PATENT DOCUMENTS

| | | | |
|---|---|---|---|
| 3,827,488 | 8/1974 | Piazza et al. | 285/142 X |
| 4,607,865 | 8/1986 | Hughes | 285/141 X |
| 4,653,589 | 3/1987 | Alandy | 166/208 X |
| 4,836,579 | 6/1989 | Wester et al. | 285/141 X |
| 4,903,776 | 2/1990 | Nobileau | 166/382 |
| 4,949,786 | 8/1990 | Eckert et al. | 166/217 X |
| 4,949,791 | 8/1990 | Hopmann et al. | 166/77.5 X |
| 5,026,097 | 6/1991 | Reimert | 166/348 X |

*Primary Examiner*—Ramon S. Britts
*Assistant Examiner*—Roger J. Schoeppel
*Attorney, Agent, or Firm*—James E. Bradley

[57] ABSTRACT

A well assembly utilizes a casing tensioning system that allows a preselected amount of stretch to be applied in the casing. The assembly includes a tubular mandrel that secures to the upper end of the string of casing. A load ring has internal grooves that mate with exterior grooves on the mandrel, the load ring being of a ratcheting type. A retainer will latch the load ring in the wellhead housing. A positioning ring mounts to an upper portion of the mandrel to position the load ring at a desired distance above a stop shoulder on the lower portion of the mandrel and the load ring. During tensioning, the load ring remains stationary in the wellhead housing as the mandrel is pulled upward until the stop shoulder contacts the load ring.

19 Claims, 2 Drawing Sheets

PRESELECTED CASING TENSIONING SYSTEM

BACKGROUND OF THE INVENTION

1. Field of the Invention

This invention relates in general to oil and gas well drilling equipment, and in particular to an apparatus for tensioning a section of casing.

2. Description of the Prior Art

In oil and gas well drilling, the casing will be cemented in the well. In some well installations, the operator will tension the casing above the level of cement, and support the casing in tension at the wellhead. For example in one type of offshore drilling, the level of cement around the casing will be located at or below the sea floor. The casing extends upward to a surface wellhead housing at the drilling or production platform. The surface wellhead will have pressure control equipment. In very deep water, the extension of casing above the sea floor could be a considerable distance.

The section of the casing extending from the level of cement to the surface wellhead housing must be placed in tension. This is handled by pulling upward on the section with a drilling rig, then anchoring the casing in tension at the surface wellhead housing. Various devices to maintain the casing in tension are available.

Under the prior techniques, the amount of tension depends upon the amount of overpull applied by the drilling rig. An operator may have means for calculating in advance how much stretch that he wishes to place in the casing. However, it is difficult to precisely pull and maintain the calculated amount of stretch. Normally, the operator marks the pipe, then pulls it upward for the calculated amount. The operator then attempts to hang the casing in the wellhead housing at the desired point of stretch.

SUMMARY OF THE INVENTION

In this invention, an assembly is provided for preselecting an amount of tension to be applied to a string of casing and for supporting the casing in a surface wellhead housing at the desired level of tension. The assembly includes a tubular mandrel which secures to the upper end of the string of casing. The mandrel is divided into an upper portion and a lower portion. The upper portion, which may be considered a running tool, is removed after the casing is supported in the wellhead housing. The lower portion of the mandrel secures to the string of casing and remains in the surface wellhead.

The upper portion of the mandrel has a set of grooves which are preferably threads. The lower portion of the mandrel has a set of grooves which are preferably wickers. A load ring has interior grooves which frictionally slide on the threads of the upper portion of the mandrel and ratchet on the wickers on the lower portion of the mandrel to allow upward movement of the mandrel relative to load ring. Once the load ring engages the wickers, the mandrel can only move upward relative to the load ring, not downward. A retainer will latch the load ring in the surface wellhead housing on a load shoulder.

The lower portion of the mandrel has an external stop shoulder. A positioning member secures to the exterior threads of the upper portion of the mandrel at selected positions. The load ring will be initially placed below and in contact with the positioning member. The positioning member locates the load ring in an initial position prior to any tension being applied. This positioning member predetermines the distance between the stop shoulder on the exterior of the mandrel and the load ring when the load ring initially latches into the wellhead housing.

After the load ring latches in the wellhead housing, the operator pulls upward on the casing string, stretching the casing, until the mandrel stop shoulder bumps against the load ring. The operator then slacks off, with the load ring maintaining tension at that point. The upper running tool portion of the mandrel is then removed.

DETAILED DESCRIPTION OF THE INVENTION

Figure 1:
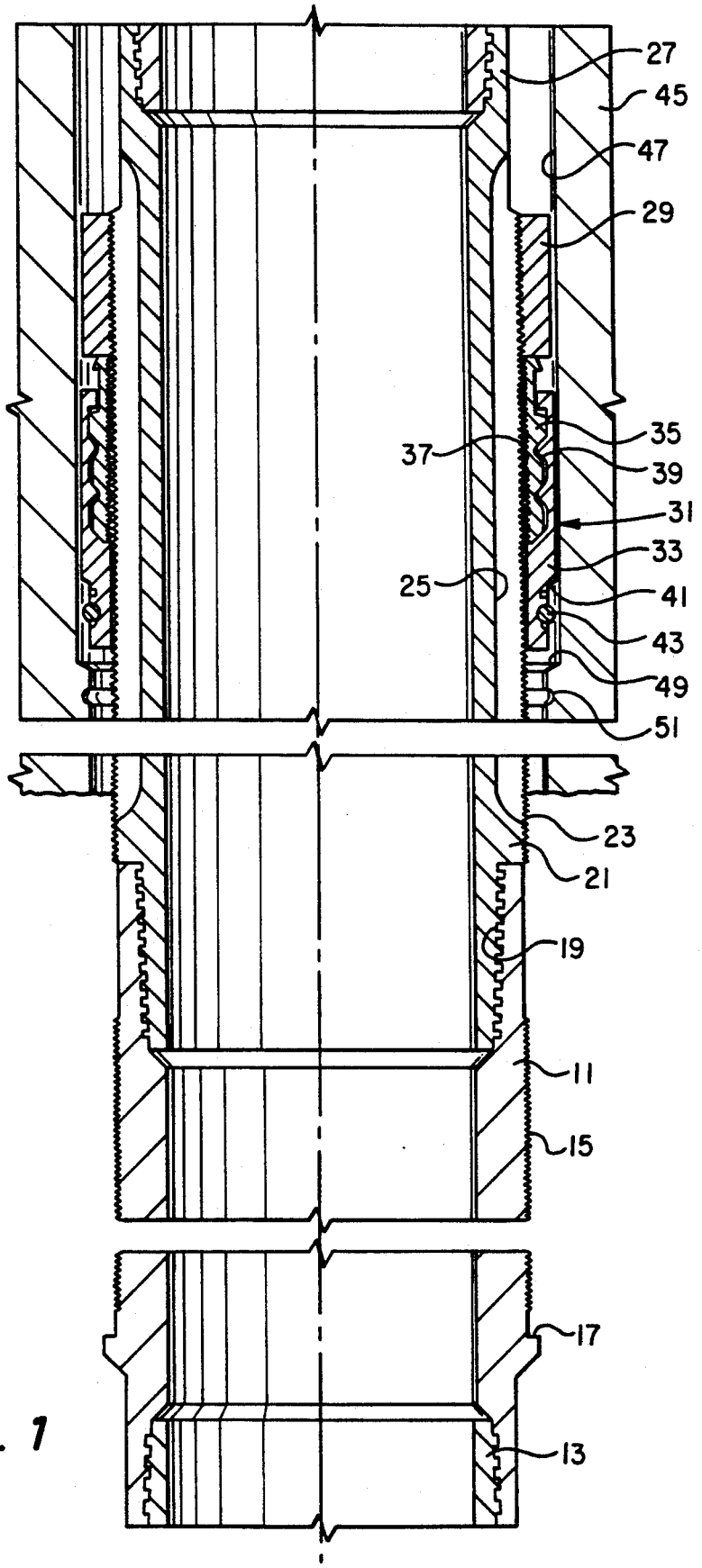
FIGS. 1 is a partially schematic, sectional view illustrating a casing tensioning system constructed in accordance with this invention, and showing the assembly prior to landing in the surface wellhead housing.

Referring to FIG. 1, the casing tensioning apparatus of this invention includes a tubular mandrel 11. Mandrel 11 has a lower end that is internally threaded to secure to the upper end of a string of casing 13. Casing 13 will extend upward from a well and will have a portion which will be eventually placed in tension Mandrel 11 has external grooves 15, which are preferably circumferential wickers that are of relatively small pitch and triangular in configuration. Wickers 15 are not helical threads, rather comprise parallel grooves. Wickers 15 extend a substantial distance along the length of mandrel 11, terminating a short distance below the upper end of mandrel 11. A stop shoulder 17 located on the exterior of mandrel 11 near the lower end. Stop shoulder 17 faces upward. The upper end of mandrel 11 is internally threaded for receiving a running tool 21.

Figure 3:
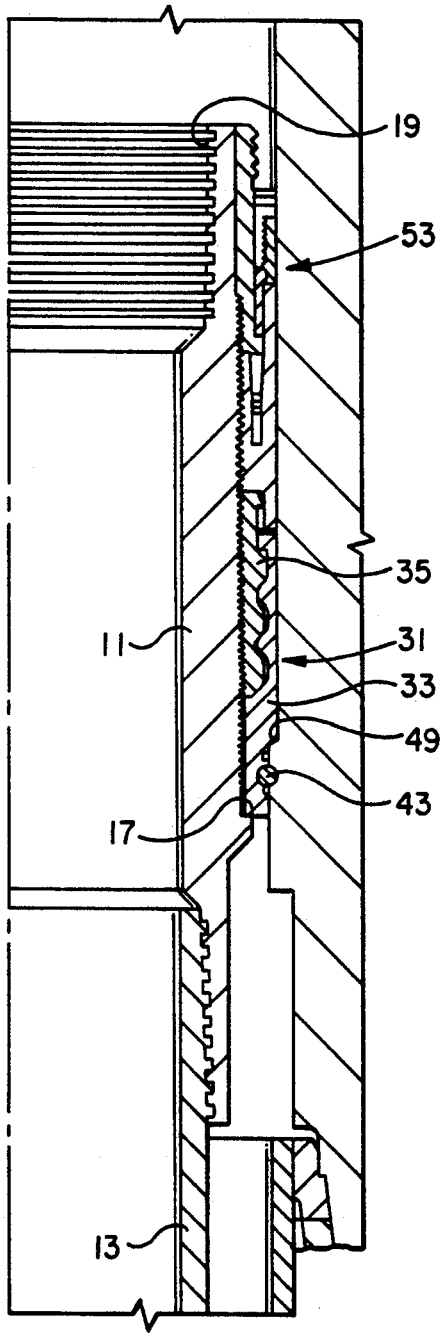
FIG. 3 is another quarter sectional view of the system of FIG. 1, showing the casing under tension, the running tool removed, and a casing hanger seal installed.

Running tool 21, which may be considered to be an upper portion of mandrel 11, is used during installation of casing 13, but is removed after installation, as shown in FIG. 3. Running tool 21 has a set of grooves, preferably helical threads 23 on its exterior. Threads 23 extend from near the upper end of running tool 21 to the point at which the lower exterior portion of running tool 21 abuts the upper end of mandrel 11. A plurality of vertically extending channels or flowby slots 25 extend through the threads 23. Flowby slots 25 are spaced circumferentially around running tool 21.

Running tool 21 has an internally threaded upper end for receiving the lower end of a conduit 27, such as drill pipe, for applying an upward force to running tool 21. A positioning ring 29 secures to running tool threads 23. Positioning ring 29 is a solid ring having internal threads that allow it to be positioned at any selected point along the length of threads 23 by rotating positioning ring 29. A set screw (not shown) may be employed to lock positioning ring 29 in position once set. Positioning ring 29 is shown in the figures to be set at the uppermost point on external threads 23. The particular axial set position of positioning ring 29 will predetermine a distance from stop shoulder 17 to positioning ring 29.

Figure 2:
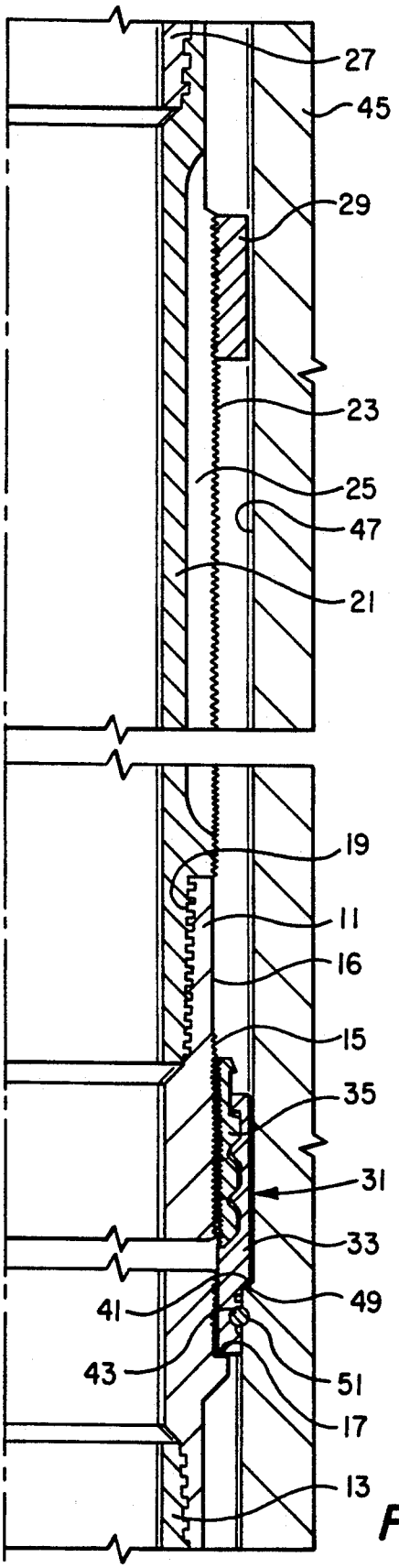
FIG. 2 is a quarter sectional view of the system of FIG. 1, showing the load ring of the system landed in the surface wellhead housing and tension applied to the preselected amount.

A two-piece load ring 31 is carried on mandrel 11 and running tool 21 between stop shoulder 17 and positioning ring 29. Load ring 31 locates initially on threads 23 of running tool 21, as shown in FIG. 1. After the casing 13 has been tensioned, load ring 31 will locate on wickers 15 of mandrel 11, as shown in FIGS. 2 and 3.

Load ring 31 has an outer ring 33 that is a solid annular member. Load ring 31 has an inner ring 35 that is split and is carried in outer ring 33. Inner ring 35 has internal wickers 37 that are of the same pitch and configuration as external wickers 15 to mate with the external wickers 15. Load ring wickers 37 do not mesh with running tool threads 23, however, split inner ring 35 has a collapsed inner diameter that is slightly less than the outer diameter of running tool 21 so that inner ring 35 will frictionally grip running tool 21 and not fall freely downward onto mandrel 11.

Inner ring 35 has external conical surfaces 39 that mate with internal conical surfaces in outer ring 33 to enable inner ring 35 to ratchet in and out over the mandrel wickers 15. The conical surfaces 39 face downward and outward so that mandrel 11 can be pulled upward relative to load ring 31, but cannot move downward. The engagement of wickers 15 and 37 prevents downward movement of mandrel 11 relative to load ring 31.

Outer ring 33 has an external downward facing shoulder 41. Outer ring 33 has a retaining ring 43 located below landing shoulder 41. Retaining ring 43 is preferably a D-shaped ring that is elastomeric and is located in a ramp-shaped groove as shown in U.S. Pat. No. 4,978,147.

Mandrel 11 and running tool 21 will locate within a wellhead housing 45, which may be located at a drilling platform. Wellhead housing 45 has an axial bore 47 with an upward facing load shoulder 49. Wellhead housing 45 is conventional except for the addition of a latching groove 51, which is positioned below load shoulder 49 for receiving retaining ring 43. Once retaining ring 43 latches into groove 51, load ring 31 will be held stationarily within wellhead housing 45.

In operation, the operator will calculate the amount of stretch that he wishes to place in the unsupported portion of casing 13 below wellhead housing 45. In this embodiment, the unsupported portion begins at the upper level of cement and extends to the wellhead housing 45. The operator will then secure positioning ring 29 at a particular point along external threads 23 to predetermine the distance between stop shoulder 17 and landing shoulder 41 of load ring 31. Load ring 31 will be positioned on running tool 21 with its upper end in contact with the lower end of positioning ring 29. The initial distance from the lower end of load ring 31 to stop shoulder 17 will equal the desired amount of stretch. The bias of split inner ring 35 will frictionally hold load ring 31 in place until retaining ring 43 latches in groove 51.

The operator lowers the string of casing 13 into the well FIG. 1 shows the running tool 21 passing into wellhead housing 45 with landing shoulder 41 shown a short distance above load shoulder 49. When landing shoulder 41 contacts load shoulder 49, the operator will not be able to lower the casing 13 any further. Retaining ring 43 will enter groove 51, latching the load ring 31 to Wellhead housing 45. The weight on the drilling rig blocks will drop off, with the weight of the string of casing 13 now being supported by positioning ring 29, load ring 31 and load shoulder 49. Once load ring 31 is retained in wellhead housing 45, the distance from the lower end of outer ring 33 to stop shoulder 17 will be the amount of desired stretch to be pulled.

The operator will then cement the portion of casing 13 that is located in the well. Cement is pumped down the casing 13, returning up the annulus. A riser conduit will surround casing 13, enabling cement returns, which comprise displaced well fluids, to return to the drilling vessel The cement returns will flow through the flowby slots 25 into the drilling vessel. The cement level at the conclusion of cementing will be no higher than the sea floor. The hardened cement secures the casing 13 in the well.

After the cement has set, the operator will then apply tension to the portion of casing 13 located above the upper level of the cement. The operator pulls on conduit 27 with the drilling rig blocks, causing running tool 21 to move upward. Retaining ring 43 prevents load ring 31 from moving upward. As running tool 21 moves upward relative to load ring 31, the inner ring 35 will slide frictionally on the running tool threads 23. If the operator stopped upward pull while running tool 21 was still in load ring 31, load ring 31 would not support any load on running tool 21, rather it would move downward relative to load ring 31. Load ring 31 will support load only when wickers 15 enter load ring 31.

Eventually, the mandrel 11 will enter the inner ring 35. At this time, wickers 37 of inner ring 35 will ratchet on wickers 15. The inner ring 35 will slide radially inward and outward on conical surfaces 39 during this ratcheting movement. The operator continues pulling until stop shoulder 17 contacts the lower end of outer ring 33. When latched, retaining ring 43 requires a great deal of overpull in order to be pulled loose from groove 51, thus providing an indication to the operator that stop shoulder 17 has contacted load ring 31. This signals the operator to cease upward pulling, as the operator will not wish to pull retaining ring 43 from groove 51.

The operator slacks off tension in the drilling rig blocks. The inner ring 35 prevents mandrel from moving downward. The tension in mandrel 11 is maintained through a load path through inner ring 35, outer ring 33 and load shoulder 49. This is the position shown in FIG. 2.

The operator then unscrews running tool 21, removing it along with the positioning ring 29. Casing 13 will have stretched an amount equal to the initial distance from the stop shoulder 17 to the outer ring 33 of load ring 31. The operator then installs a conventional seal 53 between mandrel 11 and wellhead housing 45. Seal 53 engages and seals against wickers 15. Seal 53 may be of a type as shown in U.S. Pat. No. 4,932,472.

If the operator later wishes to remove the casing tensioning system to retrieve casing 13, he may do so by first retrieving seal 53. Then, by applying an extensive overpull, the operator can pull retaining ring 43 from groove 51 to remove load ring 31.

The invention has significant advantages. The system maintains tension in the casing between the subsea wellhead and the wellhead housing. The system provides a precise amount of stretch that is calculated before applying the tension.

While the invention has been shown in only one of its forms, it should be apparent to those skilled in the art that it is not so limited but is susceptible to various changes without departing from the scope of the invention.

I claim:

1. In a well assembly having a string of casing which secures in a well and extends upward to a wellhead housing which has an internal load shoulder, an apparatus for maintaining tension in the string of casing, comprising in combination:

a tubular mandrel having means for securing to the upper end of the string of casing, the mandrel having a lower portion and an upper portion, the lower portion having a set of exterior grooves;

a load ring having ratchet means including a set of interior grooves which engage the exterior grooves for allowing upward movement of the mandrel relative to the load ring but preventing downward movement of the mandrel relative to the load ring when the load ring is in engagement with the exterior grooves;

retaining means for retaining the load ring in the wellhead housing on the internal load shoulder for allowing the mandrel to be pulled upward relative to the load ring;

an external stop shoulder on the lower portion of the mandrel; and positioning means for mounting on the upper portion of the mandrel at selected locations above the stop shoulder for initially providing a preselected distance between the stop shoulder and the load ring after the load ring is retained in the wellhead housing and the string of casing secured in the well, but prior to applying tension to the string of casing, so that subsequently pulling the mandrel upward will stretch the string of casing until the stop shoulder contacts the load ring, the amount of stretch being equal to the preselected distance, the load ring subsequently supporting the string of casing in tension on the load shoulder.

2. The assembly according to claim wherein the positioning means comprises a positioning member which is securable to the upper portion of the mandrel at variable distances from the stop shoulder, the upper end of the load ring engaging the positioning member after the load ring is retained in the housing and prior to pulling the mandrel upward.

3. The assembly according to claim 1 wherein the positioning means comprises:

a set of exterior threads on the upper portion of the mandrel; and a positioning ring having internal threads that engage the exterior threads on the upper portion of the mandrel to allow the positioning ring to be positioned at a selected distance from the stop shoulder, the upper end of the load ring engaging the positioning ring after the load ring is retained in the housing and prior to pulling the mandrel upward.

4. The assembly according to claim 1 wherein the upper portion of the mandrel is secured by threads to the lower portion of the mandrel, allowing the upper portion of the mandrel to be removed after the selected amount of tension has been pulled and the tension transferred to the load ring and load shoulder.

5. The assembly according to claim 1 wherein the upper portion of the mandrel has exterior vertical flowby slots to enable cement returns to flow past.

6. The assembly according to claim 1 wherein the retaining means comprises:

a recess formed in the wellhead housing adjacent the load shoulder; and a retaining ring which enters the recess when the load ring moves downward into the wellhead housing.

7. In a well assembly having a string of casing which secures in and extends upward from a well to a wellhead housing, the wellhead housing having an internal load shoulder, an apparatus for maintaining tension in the string of casing, comprising in combination:

a tubular mandrel having means for securing to the upper end of the string of casing, the mandrel having a lower portion and an upper portion, the upper portion having a set of exterior threads, the lower portion having a set of exterior grooves;

a load ring having a set of interior grooves which ratchet on the exterior grooves of the lower portion to allow upward movement of the mandrel relative to the load ring but prevent downward movement of the mandrel relative to the load ring;

retaining means for retaining the load ring in the wellhead housing on the load shoulder for allowing the mandrel to be pulled upward relative to the load ring;

an external stop shoulder on the lower portion of the mandrel; and a positioning ring having internal threads which secure to the exterior threads at a preselected variable distance above the stop shoulder, so that pulling the mandrel upward after the string of casing has been secured in the well and the load ring retained into the wellhead housing will stretch the string of casing until the stop shoulder contacts the load ring.

8. The assembly according to claim 7 wherein the load ring is initially positioned in contact with the positioning ring and held by frictional engagement of the load ring with the exterior threads when the string of casing is being lowered into the well.

9. The assembly according to claim 7 wherein the exterior grooves comprise parallel circumferential wickers.

10. The assembly according to claim 7 wherein the upper portion of the mandrel is releasably secured to the lower portion of the mandrel, allowing the upper portion of the mandrel to be removed from the wellhead housing after the selected amount of tension has been pulled and the tension transferred to the load ring and load shoulder.

11. The assembly according to claim 7 wherein the upper portion of the mandrel has exterior vertical flowby slots to enable cement returns to flow past.

12. The assembly according to claim 7 wherein the retaining means comprises:

a recess formed in the wellhead housing adjacent the load shoulder; and a retaining ring which enters the recess when the load ring moves downward into the wellhead housing.

13. In a well assembly having a string of casing which secures in and extends upward from a well to a wellhead housing, the wellhead housing having an internal load shoulder, an apparatus for maintaining tension in the string of casing, comprising in combination:

a tubular mandrel having means for securing to the upper end of the string of casing, the mandrel having a lower portion and an upper portion, a set of exterior grooves on the lower portion and a set of exterior threads on the upper portion;

a load ring having an inner member containing a set of interior grooves and an outer member having a downward facing shoulder, the inner member being radially retractable relative to the outer member to allow the inner member to ratchet on the exterior grooves, to allow upward movement of the mandrel relative to the load ring but prevent downward movement of the mandrel relative to the load ring, the load ring being initially positioned on the upper portion of the mandrel with the interior grooves frictionally engaging but not meshing with the exterior threads;

a recess formed in the wellhead housing adjacent the load shoulder;

a retaining ring mounted to the outer member of the load ring and which enters the recess when the load ring moves downward into the wellhead housing, placing the shoulder of the load ring in engagement with the load shoulder;

an external stop shoulder on the lower portion of the mandrel;

an internally threaded positioning ring secured on the threads of the upper portion of the mandrel a preselected distance above the stop shoulder, the load ring being initially positioned with an upper end in contact with the positioning ring when the string of casing is being lowered into the well, so that pulling the mandrel upward after the string of casing has been secured in the well and the load ring retained in the wellhead housing will cause the exterior threads to frictionally slide upward relative to the load ring, then cause the load ring to ratchet on the exterior grooves until the stop shoulder contacts the load ring, allowing the operator to then slack off on the upward pull on the mandrel, causing the load ring to support the string of casing in tension on the load shoulder; and the upper portion being secured by threads to the lower portion so as to be removable along with the positioning ring from the lower portion after the load ring supports the string of casing on the load shoulder.

14. The assembly according to claim 13 wherein the upper portion of the mandrel has exterior vertical flowby slots to enable cement returns to flow past the load ring and positioning ring.

15. A method of applying and maintaining tension in a string of casing extending upward from a well to a wellhead housing, the wellhead housing having an internal load shoulder, the method comprising:

providing a tubular mandrel with an upper portion and a lower portion which has a set of exterior grooves, and securing the mandrel to the upper end of the string of casing;

providing an external stop shoulder on the lower portion of the mandrel;

providing a load ring having ratchet means including a set of interior grooves which will ratchet on the exterior grooves and placing the load ring on the mandrel;

securing a positioning member to the exterior of the upper portion of the mandrel a selected variable distance above the stop shoulder;

lowering the mandrel and the string of casing and landing the load ring on the load shoulder with the positioning member in contact with the load ring;

retaining the load ring on the load shoulder against upward movement relative to the wellhead housing an securing the string of casing in the well; then pulling the mandrel and string of casing upward while retaining a lower portion of the string of casing secured in the well, thereby stretching the string of casing and causing the grooves of the load ring to ratchet on the exterior grooves until the stop shoulder contacts the load ring; then ceasing to pull upward on the mandrel and transferring tension on the mandrel to the load ring and load shoulder.

16. The method according to claim 15 wherein the step of placing the load ring on the mandrel comprises placing the load ring on the upper portion of the mandrel with an upper end of the load ring in contact with the positioning member.

17. The method according to claim 16 wherein the step of securing the positioning member to the upper portion of the mandrel comprises:

providing a set of threads on the upper portion of the mandrel; an securing the positioning member to the threads.

18. The method according to claim 16 further comprising:

removing the upper portion of the mandrel from the lower portion of the mandrel after the load ring supports the tension o the load shoulder.

19. The method according to claim 16 wherein the step of securing the string of casing in the well comprises:

cementing the string of casing in the well after retaining the load ring on the load shoulder and before pulling the mandrel upward.

* * * * *

UNITED STATES PATENT AND TRADEMARK OFFICE

CERTIFICATE OF CORRECTION

PATENT NO. : 5,311,947

DATED : May 17, 1994

INVENTOR(S) : Peter M. Kent, et al.

It is certified that error appears in the above-indentified patent and that said Letters Patent is hereby corrected as shown below:

column 3, line 66, "Wellhead" should be --wellhead--;
column 8, line 17, "an" should be --and--;
column 8, line 36, "an" should be --and--;
column 8, line 42, "o" should be --on--.

Signed and Sealed this

Eighth Day of November, 1994

Bruce Lehman

*Attest:*

BRUCE LEHMAN

*Attesting Officer*

*Commissioner of Patents and Trademarks*